US009590336B2

(12) United States Patent
Tsai et al.

(10) Patent No.: US 9,590,336 B2
(45) Date of Patent: Mar. 7, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Yang-Yang Zhou, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/147,061

(22) Filed: May 5, 2016

(65) Prior Publication Data

US 2016/0329646 A1 Nov. 10, 2016

(30) Foreign Application Priority Data

May 5, 2015 (CN) ..... 2015 1 0222935

(51) Int. Cl.

| | |
|---|---|
| ***H01R 12/00*** | (2006.01) |
| ***H01R 12/75*** | (2011.01) |
| ***H01R 12/70*** | (2011.01) |
| ***H01R 13/516*** | (2006.01) |
| ***H01R 13/6581*** | (2011.01) |

(52) U.S. Cl.

CPC ..... *H01R 12/75* (2013.01); *H01R 12/7011* (2013.01); *H01R 13/516* (2013.01); *H01R 13/6581* (2013.01)

(58) Field of Classification Search

CPC H01R 12/526; H01R 12/707; H01R 43/0235; H01R 43/0256

USPC ..... 439/910, 607.4, 607.36, 607.38, 607.35, 439/83, 912, 876

See application file for complete search history.

(56) References Cited

U.S. PATENT DOCUMENTS 1,404,887 A * 1/1922 Nystrom ..... B61D 7/18 105/239
5,096,440 A * 3/1992 Katsumata ..... H01R 9/091 439/566
5,697,799 A * 12/1997 Consoli ..... H01R 23/6873 439/181
5,975,920 A * 11/1999 Oberstarr ..... H01R 9/091 439/83
7,140,918 B1 * 11/2006 Delaney ..... H01R 23/6873 439/607.06

(Continued)

*Primary Examiner* — Phuong Dinh

(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, a plurality of second receptacle terminals, and a rear cover plate. The insulated housing is received in the receiving cavity. The first receptacle terminals and the second receptacle terminals are respectively disposed at an upper portion and a lower portion of the insulated housing. The rear cover plate includes a baffle plate and one or more hole. The hole is formed on the surface of the baffle plate for checking tail portions of the second receptacle terminals which are formed as SMT (surface mount technology) legs. Accordingly, the soldering condition between the tail portions of the second receptacle terminals and contacts of a circuit board can be checked from the hole.

12 Claims, 9 Drawing Sheets

(56) References Cited

U.S. PATENT DOCUMENTS 8,506,332 B2 * 8/2013 Sommers ..... H01R 12/725
439/607.32

* cited by examiner

100

100

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | } 31 |
| GND | RX1+ | RX1− | VBUS | SBU2 | D− | D+ | CC2 | VBUS | TX2− | TX2+ | GND | } 41 |

Fig. 6

ELECTRICAL RECEPTACLE CONNECTOR

CROSS-REFERENCES TO RELATED APPLICATIONS

This non-provisional application claims priority under 35 U.S.C. §119(a) on Patent Application No. 201510222935.9 filed in China, P.R.C. on 2015 May, 5, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, receptacle terminals held on the plastic core, and an outer iron shell circularly enclosing the plastic core. The conventional USB type-C electrical receptacle connector further comprises a rear cover plate extending from the outer iron shell. The rear cover plate is at the rear of the connector and shields the rear of the plastic core. The rear cover plate is to shield the electromagnetic radiations generated by the receptacle terminals and to prevent noise interferences.

However, in the conventional, after the USB Type-C connector is soldered with a circuit board, the legs (e.g., surface mounted technology (SMT) legs) of the receptacle terminals are at the bottom portion of the middle of the plastic core and soldered with the circuit board, the soldering condition between the contacts of the circuit board and the legs of the receptacle terminals cannot be checked, and problems like soldering spots between adjacent contacts are merged together or some of the legs are detached from the contacts may occur. As a result, once the legs are not soldered with the contacts properly, the conventional receptacle connector has to be unsoldered followed by repeating the soldering procedure again.

SUMMARY OF THE INVENTION

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, and a rear cover plate. The metallic shell comprises a shell body and a receiving cavity formed therein. The insulated housing is received in the receiving cavity. The insulated housing comprises a base portion and a tongue portion extending from one side of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction, and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The rear cover plate is extending from the rear of the metallic shell to cover the rear of the base portion. The rear cover plate comprises a baffle plate and a hole formed on the surface of the baffle plate for checking the tail portions of the second receptacle terminals.

In some embodiments, the insulated housing further comprises a rear side plate extending from the rear of the base portion to cover the tail portions of the second receptacle terminals. The rear side plate comprises a through groove. The tail portions of the second receptacle terminals and the hole correspond to the through groove.

In some embodiments, the baffle plate comprises a flat plate and a turning portion extending from one side of the plat plate toward the rear of the shell body, and the hole is formed on the surface of the flat plate.

In some embodiments, the hole is correspondable to the position of the tail portions of the second receptacle terminals.

In some embodiments, the rear cover plate further comprises a plurality of holes formed on the surface of the baffle plate for checking the tail portions of the second receptacle terminals.

In some embodiments, the shell body comprises an inner shell and a case. The inner shell is circularly enclosing the insulated housing, the case is circularly enclosing the inner shell, and the rear cover plate is extending from the rear of the case to cover the rear of the base portion.

In some embodiments, the electrical receptacle connector further comprises a circuit board. The circuit board comprises a plurality of contacts, and the tail portions of the second receptacle terminals are formed as SMT legs to be in contact with the contacts.

In some embodiments, the tail portions of the first receptacle terminals are aligned by an offset with respect to the tail portions of the second receptacle terminals. In addition, the first receptacle terminals and the second receptacle terminals have 180 degree symmetrical design with respect to a central point of the receiving cavity as the symmetrical center. Moreover, the position of the first receptacle terminals corresponds to the position of the second receptacle terminals.

Based on the above, the holes of the rear cover plate allows an observer to see therethrough and to check the soldering condition between the tail portions of the second receptacle terminals and the contacts of the circuit board. Therefore, the soldering procedure can be redone when soldering spots are not applied to the contacts and the tail portions properly, for example, if the tail portions of the second receptacle terminals and the contacts of the circuit board are not firmly in contact with each other, or if the soldering spots between the tail portions of the second receptacle terminals are merged together to cause short circuit.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6 illustrates a schematic configuration diagram of the receptacle terminals of the electrical receptacle connector shown in FIG. 5;

DETAILED DESCRIPTION

Figure 1:
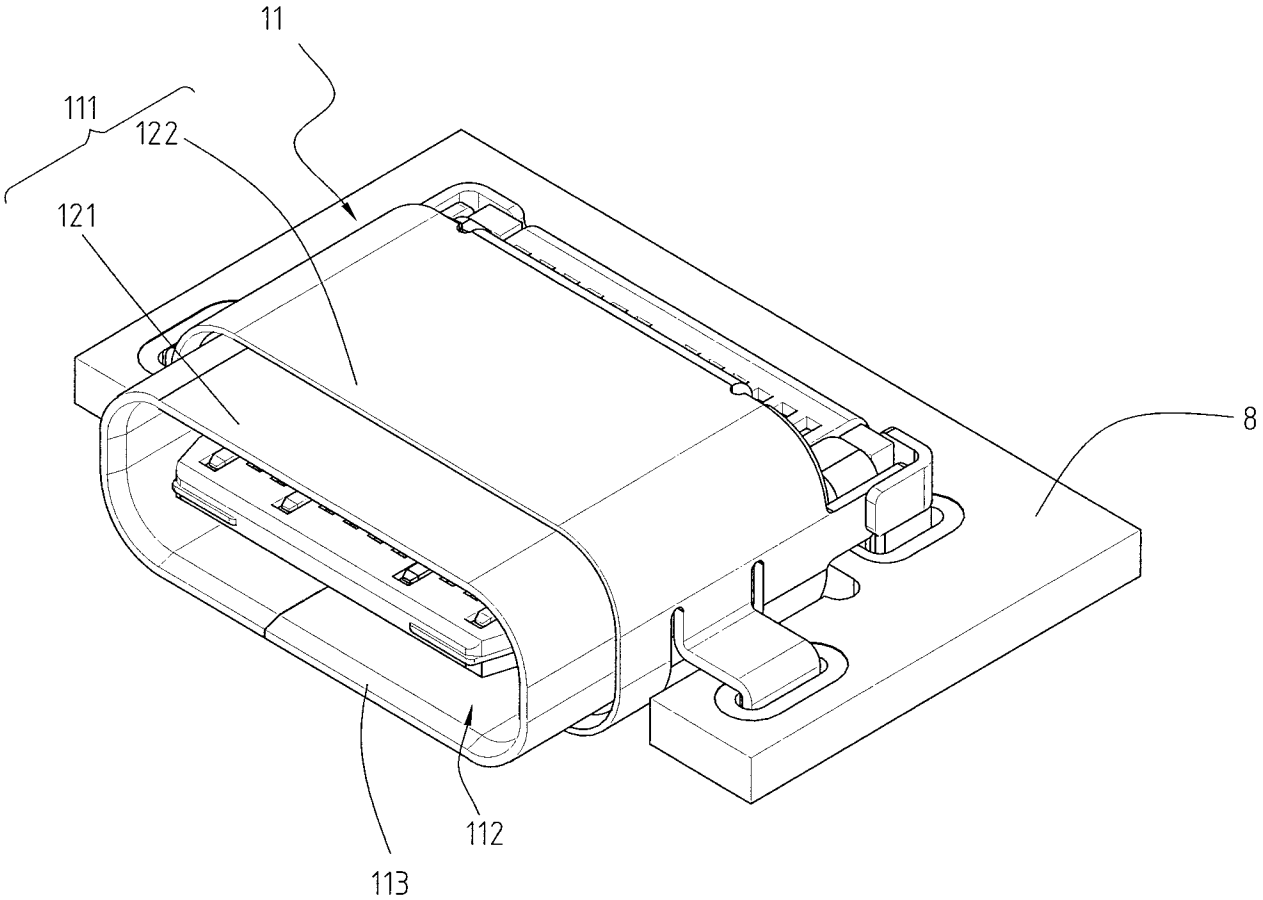
FIG. 1 illustrates a perspective view (1) of an electrical receptacle connector according to an exemplary embodiment of the instant disclosure.
Figure 2:
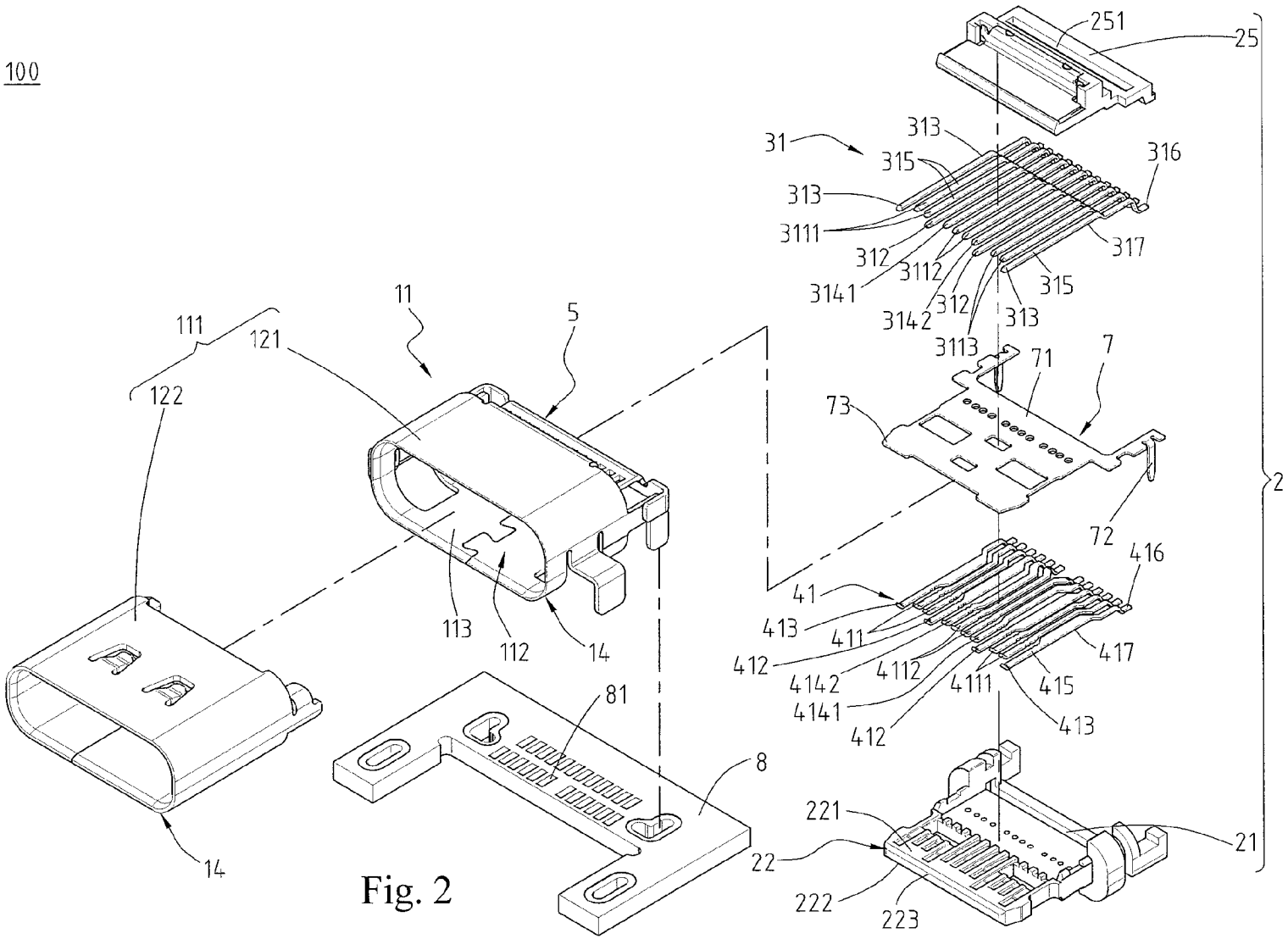
FIG. 2 illustrates an exploded view of the electrical receptacle connector.
Figure 3:
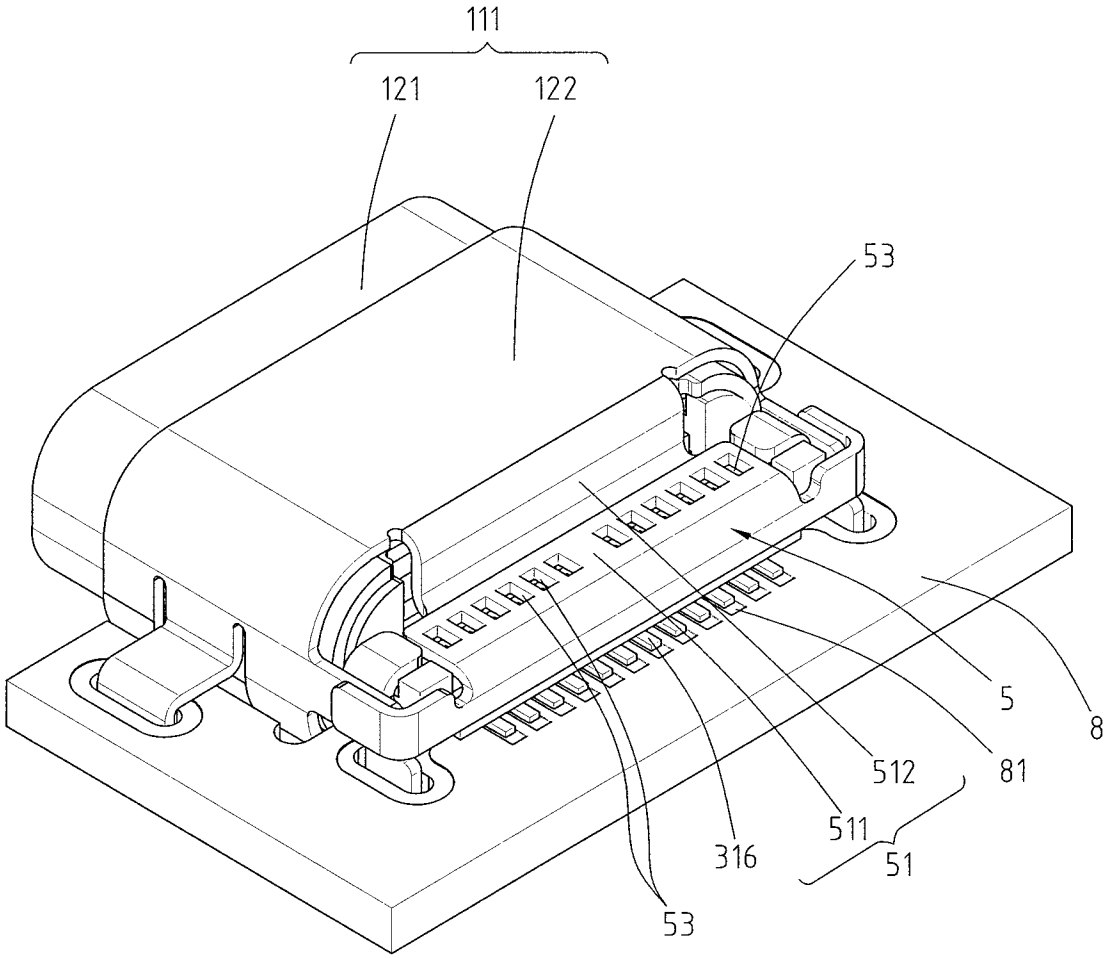
FIG. 3 illustrates a perspective view (2) of the electrical receptacle connector.
Figure 4:
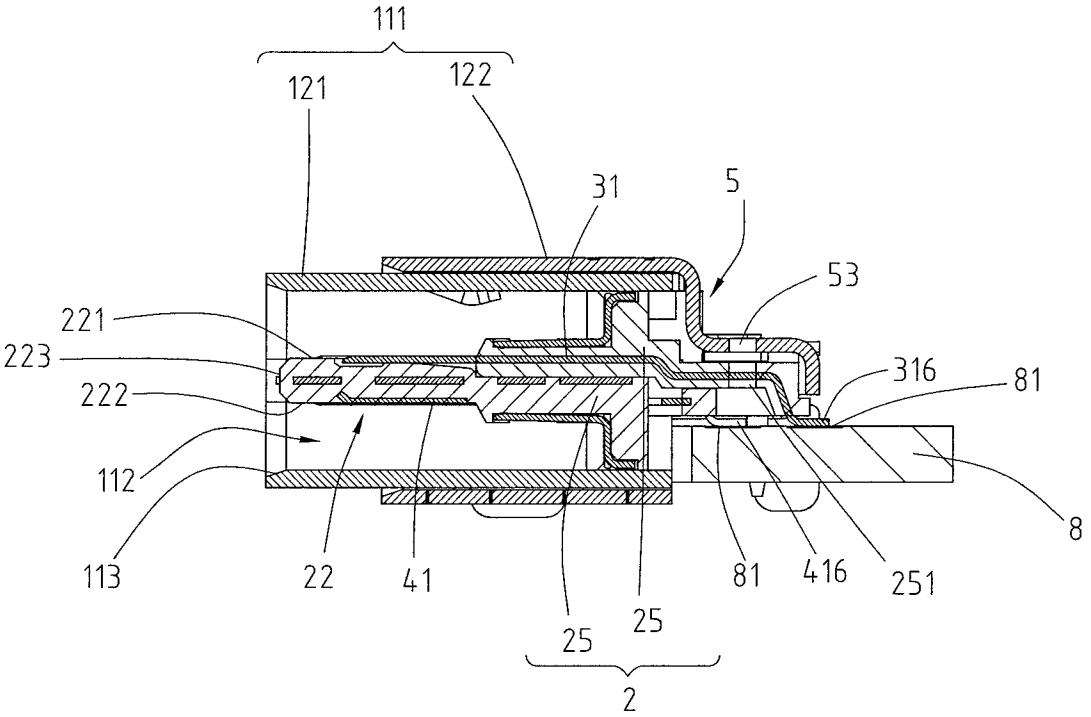
FIG. 4 illustrates a lateral sectional view of the electrical receptacle connector.

Please refer to FIGS. 1 to 4, which illustrate an electrical receptacle connector 100 of an exemplary embodiment of the instant disclosure. FIG. 1 illustrates a perspective view (1) of an electrical receptacle connector 100. FIG. 2 illustrates an exploded view of the electrical receptacle connector 100. FIG. 3 illustrates a perspective view (2) of the electrical receptacle connector 100. FIG. 4 illustrates a lateral sectional view of the electrical receptacle connector 100. In this embodiment, the electrical receptacle connector 100 is assembled with a circuit board 8 by sinking technique. That is, one side of the circuit board 8 is cut to form a crack, and the electrical receptacle connector 100 is positioned at the crack and extending toward the side portion of the circuit board 8, but embodiments are not limited thereto. In some embodiments, the electrical receptacle connector 100 may be directly soldered on the surface of the circuit board 8, as shown in FIG. 12. In other words, in such embodiment, the circuit board 8 does not have the crack for receiving the electrical receptacle connector 100, and the electrical receptacle connector 100 can be freely assembled on and electrically connected to any portion of the surface of the circuit board 8 without altering the structure of the components inside the connector. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, a plurality of second receptacle terminals 41, and a rear cover plate 5.

The metallic shell 11 is a hollowed shell, and the metallic shell 11 comprises a shell body 111 and a receiving cavity 112 formed in the shell body 111. In this embodiment, the shell body 111 is a tubular structure and defines the receiving cavity 112 therein. While in some embodiments, the metallic shell 11 may be formed by a multi-piece member; in such embodiments, the shell body 111 further comprises an inner shell 121 and a case 122. The inner shell 121 is a tubular structure circularly enclosing the insulated housing 2, and the case 122 may also be a tubular structure circularly enclosing the inner shell 121 and provided as an outer shell structure of the inner shell 121. Alternatively, the case 122 may be a semi-tubular structure which has a U-shaped cross section, and the case 122 can be covered on the top and two sides of the inner shell 121 and provided as an outer shell structure of the inner shell 121. In this embodiment, the rear cover plate 5 is at the rear of the case 122, but embodiments are not limited thereto. In some embodiments, the rear cover plate 5 may be at the rear of the inner shell 121 and the case 122 is omitted. In addition, an inserting opening 113 with oblong shaped is formed at one side of the metallic shell 11, and the inserting opening 113 communicates with the receiving cavity 112.

The insulated housing 2 is received in the receiving cavity 112 of the metallic shell 11. The insulated housing 2 comprises a base portion 21 and a tongue portion 22. In this embodiment, the base portion 21 and the tongue portion 22 may be made by injection molding or the like, and a grounding plate 7 is formed in the base portion 21 and the tongue portion 22. Moreover, the tongue portion 22 is extending from one side of the base portion 21. The tongue portion 22 has two opposite surfaces, one is a first surface 221 (i.e., the upper surface), and the other is a second surface 222 (i.e., the lower surface). The tongue portion 22 further comprises a front lateral surface 223. In this embodiment, the insulated housing 2 further comprises a rear side plate 25 extending from the rear of the base portion 21, and the rear side plate 25 comprises a through groove 251.

Please refer to FIGS. 2, 4, and 6. The first receptacle terminals 31 comprise a plurality of first signal terminals 311, at least one power terminal 312, and at least one ground terminal 313. Referring to FIG. 6, the first receptacle terminals 31 comprise, from left to right, a ground terminal 313 (Gnd), a first pair of first signal terminals 3111 (TX1+−, differential signal terminals), a power terminal 312 (Power/VBUS), a first function detection terminal 3141 (CC1, a terminal for inserting orientation detection of the connector and for cable recognition), a second pair of first signal terminals 3112 (D+−, differential signal terminals), a supplement terminal 3142 (SBU1, a terminal can be reserved for other purposes), another power terminal 312 (Power/VBUS), a third pair of first signal terminals 3113 (RX2+−, differential signal terminals), and another ground terminal 313 (Gnd). In this embodiment, twelve first receptacle terminals 31 are provided for transmitting USB 3.0 signals. In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the rightmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2, 4, and 6. The first receptacle terminals 31 are held in the base portion 21 and the tongue portion 22. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruded from the base portion 21. The first signal terminals 311 are disposed at the first surface 221 and transmit first signals (namely, USB 3.0 signals). The tail portions 316 are protruded from the bottom of the base portion 21. In addition, the tail portions 316 may be, but not limited to, bent horizontally to form flat legs, named SMT (surface mounted technology) legs, which can be mounted or soldered on the surface of a printed circuit board by using surface mount technology. In some embodiments, the tail portions 316 are extending downwardly to form vertical legs, named through-hole legs, that are inserted into holes drilled in a printed circuit board by using through-hole technology.

Please refer to FIGS. 2, 4, and 6. The second receptacle terminals 41 comprise a plurality of second signal terminals 411, at least one power terminal 412, and at least one ground terminal 413. Referring to FIG. 6, the second receptacle terminals 41 comprise, from right to left, a ground terminal 413 (Gnd), a first pair of second signal terminals 4111 (TX2+−, differential signal terminals), a power terminal 412 (Power/VBUS), a second function detection terminal 4141 (CC2, a terminal for inserting orientation detection of the connector and for cable recognition), a second pair of second signal terminals 4112 (D+−, differential signal terminals), a supplement terminal 4142 (SBU2, a terminal can be reserved for other purposes), another power terminals 412 (Power/VBUS), a third pair of second signal terminals 4113 (RX1+1, differential signal terminals), and another ground terminal 413 (Gnd). In this embodiment, twelve second receptacle terminals 41 are provided for transmitting USB 3.0 signals. In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 4, and 6. The second receptacle terminals 41 are held in the base portion 21 and the tongue portion 22. The length of each of the first receptacle terminals 31 is greater than that of the corresponding second receptacle terminal 41; that is, the exposed length of each of the first receptacle terminals 31 is greater than that of the corresponding second receptacle terminal 41. Each of the second receptacle terminals 41 comprises a flat contact portion 415, a body portion 417, and a tail portion 416. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruded from the base portion 21. The second signal terminals 411 are disposed at the second surface 222 and provided for transmitting second signals (i.e., USB 3.0 signals). The tail portions 416 are protruded from the bottom of the base portion 21. In addition, the tail portions 416 may be, but not limited to, bent horizontally to form flat legs, named SMT legs, which can be mounted or soldered on the surface of a printed circuit board by using surface mount technology.

Please refer to FIGS. 2, 4, and 6. In this embodiment, the first receptacle terminals 31 and the second receptacle terminals 41 are respectively disposed at the first surface 221 and the second surface 222 of the tongue portion 22. Additionally, pin-assignments of the first receptacle terminals 31 and the second receptacle terminals 41 are point-symmetrical with a central point of the receiving cavity 112 as the symmetrical center. In other words, pin-assignments of the first receptacle terminals 31 and the second receptacle terminals 41 have 180 degree symmetrical design with respect to the central point of the receiving cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Please refer to FIGS. 2, 4, and 6. In this embodiment, as viewed from the front of the receptacle terminals 31, 41, the position of the first receptacle terminals 31 corresponds to the position of the second receptacle terminals 41.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2, 4 and 6. In this embodiment, the tail portions 316, 416 are protruded from the base portion 211 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 2, 4, and 6. In this embodiment, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. In addition, the position of the tail portions 316 may correspond to the position of the tail portion 416. Alternatively, the tail portions 316 may be aligned by an offset with respect to the tail portions 416. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of first signal terminals 3111 (TX1+−) and the third pair of first signal terminals 3113 (RX2+−) are omitted, and the second pair of first signal terminals 3112 (D+−) 41 and the power terminals 312 (Power/VBUS) are retained. While for the second receptacle terminals 41 in accordance with transmission of USB 2.0 signals, the first pair of second signal terminals 4111 (TX2+−) and the third pair of second signal terminals 4113 (RX1+−) are omitted, and the second pair of second signal terminals 4112 (D+−) and the power terminals 412 (Power/VBUS) are retained.

Figure 8:
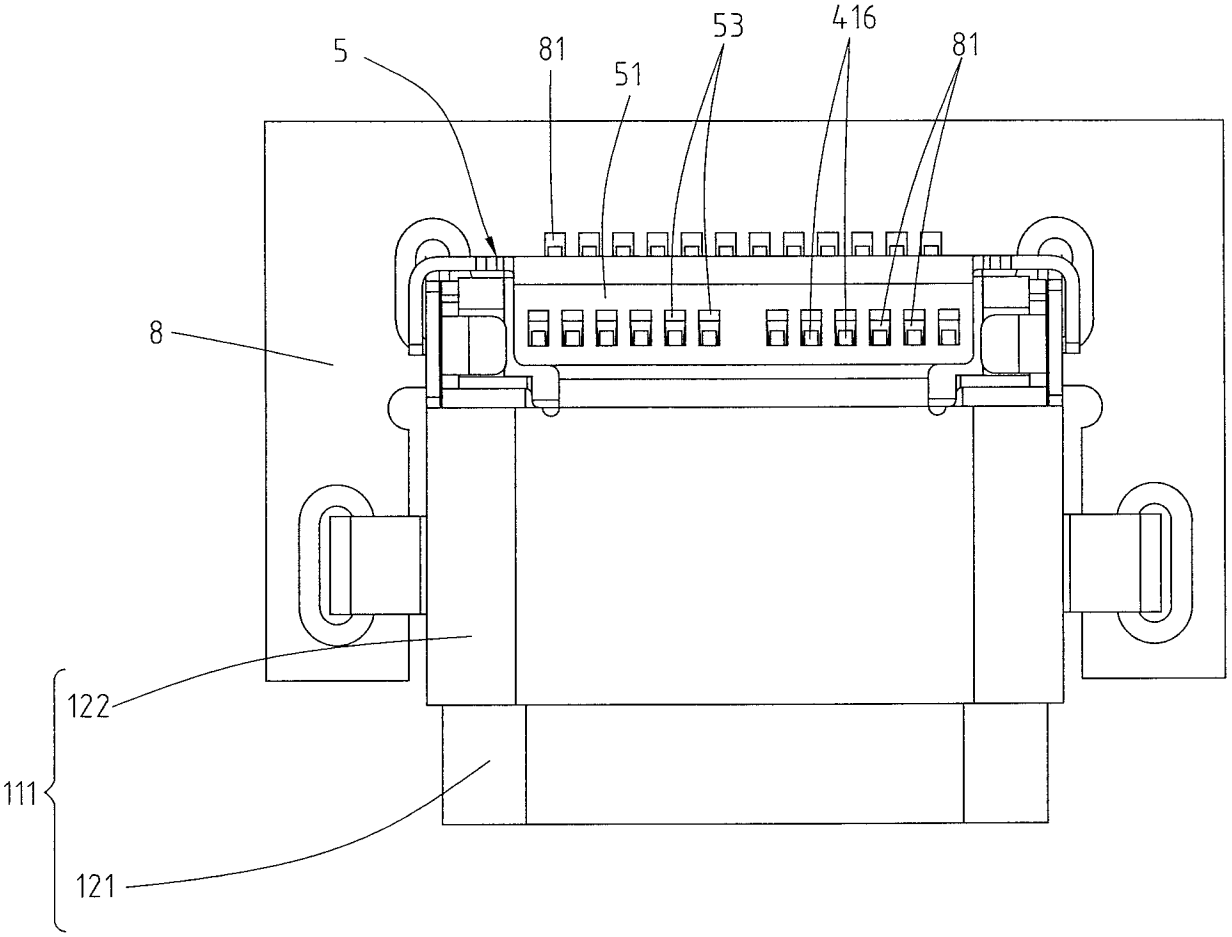
FIG. 8 illustrates a top view of the electrical receptacle connector.

Please refer to FIGS. 2, 3, 7, and 8. The rear cover plate 5 is an elongate plate and is at the rear of the metallic shell 5. In addition, the rear cover plate 5 and the metallic shell 11 may be a unitary member or separated members. In this embodiment, the rear cover plate 5 and the metallic shell 11 are formed as a unitary member and the rear cover plate 5 comprises a baffle plate 51 and a plurality of holes 53. In this embodiment, the baffle plate 51 comprises a flat plate 511 and a turning portion 512 extending from one side of the flat plate 511 toward the rear of the shell body 111. The holes 53 are formed on the surface of the flat plate 511. The number and the position of the holes 53 may be or may not be correspond to the number and the position of the tail portions 416 of the second receptacle terminals 41. As shown in FIG. 8, the holes 53 correspond to the tail portions 416 of the second receptacle terminals 41, but embodiments are not limited thereto. In detail, in the embodiment of FIG. 8, each of the tail portions 416 of the second receptacle terminals 41 is seen through the visible region of the corresponding hole 53. In FIG. 9B, the holes 53 do not correspond to the tail portions 416 of the second receptacle terminals 41 but correspond to the portions between tail portions 416 of the second receptacle terminals 41. In detail, in the embodiment shown in FIG. 9B, a portion of a tail portion 416 and a portion of an adjacent tail portion 416 are seen through the visible region of each of the holes 53. In addition, the width of the hole 53 may be less than, greater than, or equal to the width of the tail portion 416 of the second receptacle terminal 41.

Please refer to FIGS. 2, 3, 7, and 8. The tail portions 316 of the first receptacle terminals 31 are protruded from the bottom of the rear side plate 25 outward. The positions of the tail portions 316 of the first receptacle terminals 31, the tail portions 416 of the second receptacle terminals 41, and the holes 53 on the rear cover plate 5 correspond to the position of the through groove 251. Because of the offset alignment between the tail portions 316 of the first receptacle terminals 31 and the tail portions 416 of the second receptacle terminals 41, the tail portions 416 of the second receptacle terminals 41 would not be shielded by the tail portions 316 of the first receptacle terminals 31 when being viewed from the holes 53. Therefore, an observer (who may be a user or an operator) can check if the tail portions 416 of the second receptacle terminals 41 and the contacts 81 of the circuit board 8 are firmly in contact with each other and check if the soldering spots between the tail portions 416 of the second receptacle terminals 41 are merged together to cause short circuit. The soldering procedure can be redone when soldering spots are not applied to the contacts 81 and the tail portions 416 properly. Here, the term "check" means to perform visual inspection, i.e., to see through the holes 53 if the contacts 81 of the circuit board 8 are firmly soldered with the tail portions 416 (as SMT legs) of the second receptacle terminals 41 or if the soldering procedure should be redone. In the contrary, because the positions of the tail portions 416 of the second receptacle terminals 41 are at the lower portion of the rear side plate 25, once the rear cover plate 25 is devoid of the holes 53, the observer cannot check the soldering condition between the tail portions 416 of the second receptacle terminals 41 and the contacts 81 of the circuit board 8 after the electrical receptacle connector 100 is assembled to the circuit board 8.

Figure 9A:
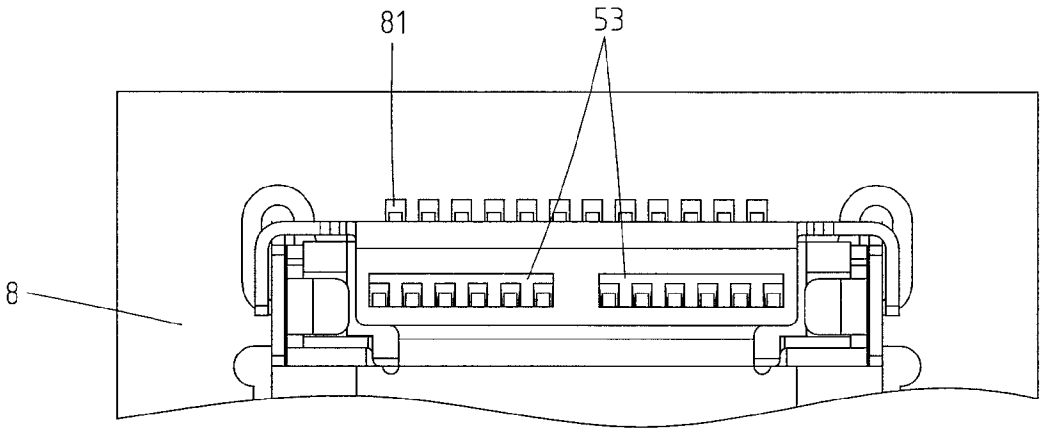
FIG. 9A illustrates a partial top view of one embodiment of the electrical receptacle connector in which the electrical receptacle connector has different number of holes.
Figure 9B:
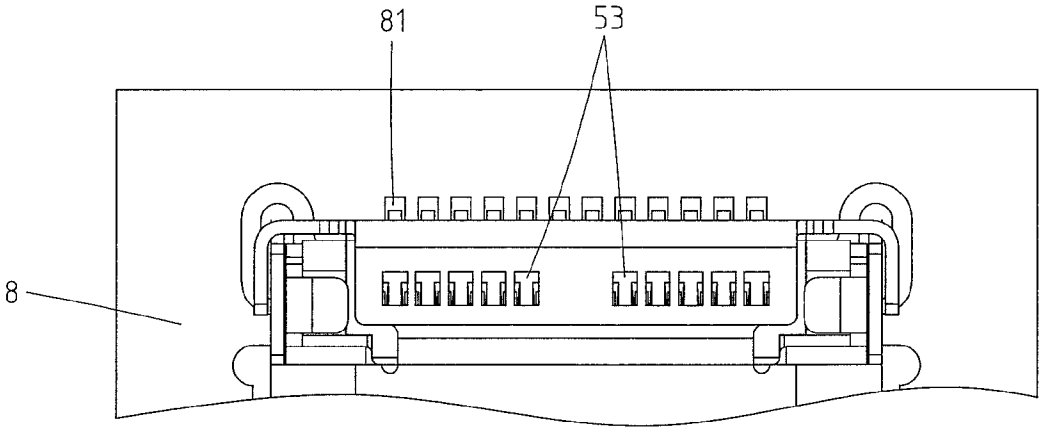
FIG. 9B illustrates a partial top view of another embodiment of the electrical receptacle connector in which the position of holes of the electrical receptacle connector is different.

Please refer to FIG. 9A. In some embodiments, the rear cover plate 5 may have two or more holes 53. By increasing the width of the hole 53, the soldering condition between the tail portions 416 of the second receptacle terminals 41 and the contacts 81 of the circuit board 8 therefore can be checked, but embodiments are not limited thereto. In some embodiments, the width of the hole 53 is less than or equal to the width of the tail portion 416 of the second receptacle terminal 41, and an observer can check, through the holes 53 by adjusting the angle of his or her eyesight, the overall soldering condition between the tail portions 416 of the second receptacle terminals 41 and the contacts 81 of the circuit board 8. For example, by seeing through the holes 53, the observer may check the left sides of the tail portions 416 of the second receptacle terminals 41 firstly followed by checking the right sides of the tail portions 416 of the second receptacle terminals 41. In some embodiments, the rear cover plate 5 may comprise a hole 53 having a greater width than that of the forgoing embodiment, so that the observer can check the soldering condition between the tail portions 416 of the second receptacle terminals 41 and the contacts 81 of the circuit board 8 through the hole 53. In the two foregoing embodiments, several tail portions 416 of the second receptacle terminals 41 can be seen through the visible region of each of the holes 53. It is understood that, because the baffle plate 51 is not closely attached to the tail portions 416 of the second receptacle terminals 41, the actual size of the hole 53 is substantially smaller than the size of the visible region of the hole 53.

Please refer to FIG. 3. In this embodiment, the rear cover plate 5 further comprises a plurality of fixing pieces at two sides of the baffle plate 51, and the metallic shell 11 further comprises a plurality of lateral plates at two sides of the shell body 111. When the rear cover plate 5 covers the rear of the metallic shell 11, the fixing pieces are respectively buckled with the lateral plates.

Figure 5:
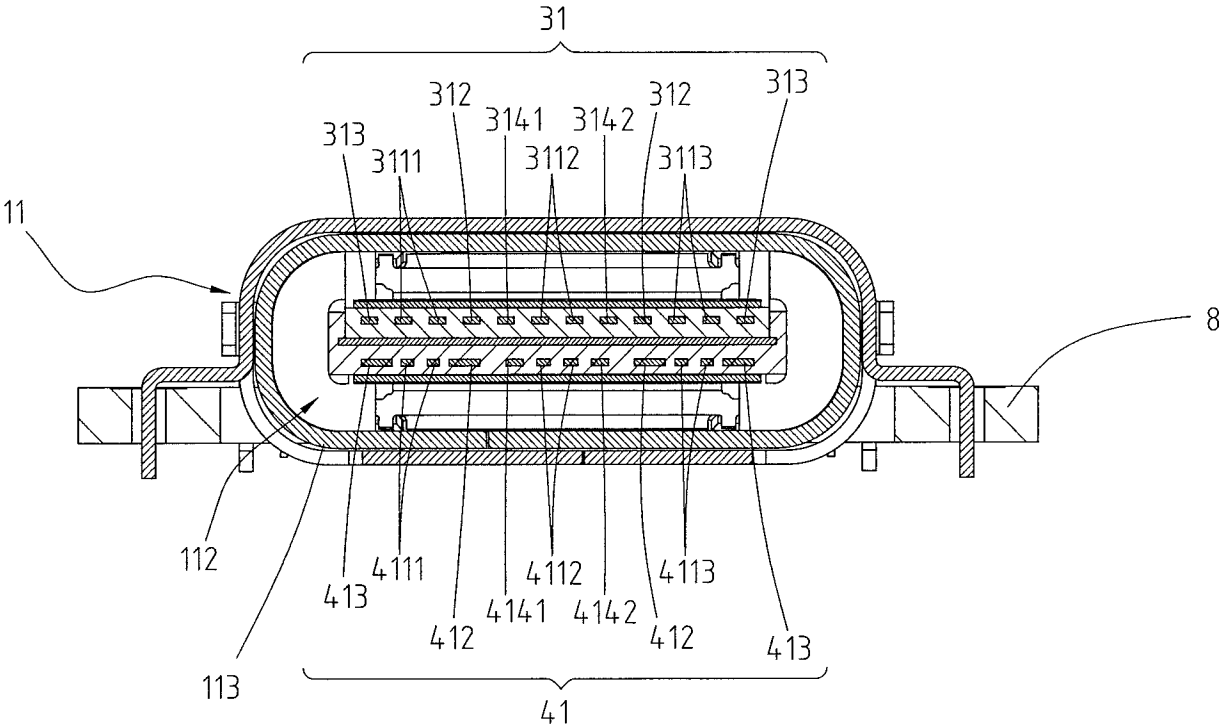
FIG. 5 illustrates a front sectional view of the electrical receptacle connector.
Figure 7:
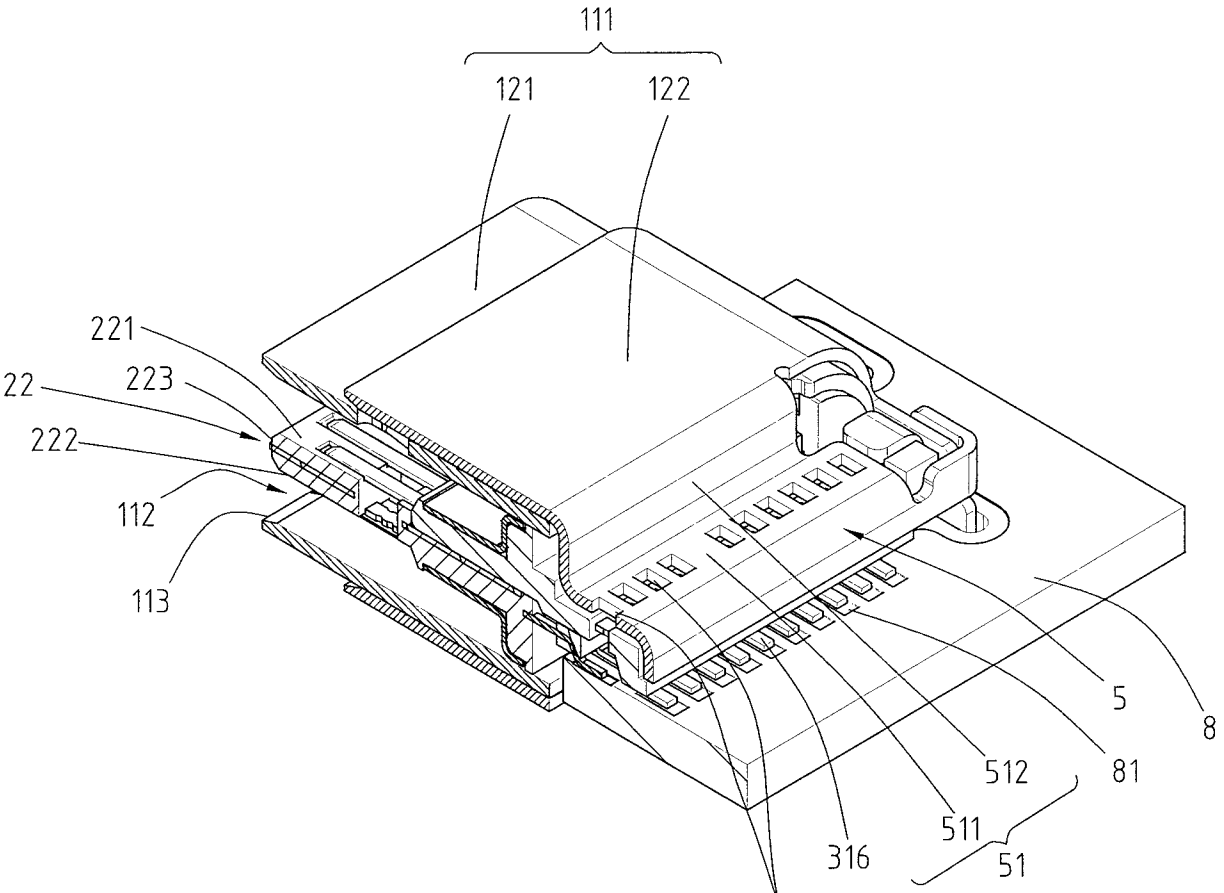
FIG. 7 illustrates a sectioned perspective view of the electrical receptacle connector.

Please refer to FIGS. 2, 4, and 5. In some embodiments, the electrical receptacle connector 100 further comprises a grounding plate 7 at the insulated housing 2. The grounding plate 7 comprises a plate body 71 and a plurality of legs 72. The plate body 71 is between the flat contact portions 315 of the first receptacle terminals 31 and the flat contact portions 415 of the second receptacle terminals 41. In other words, the plate body 71 is held in the base portion 21 and the tongue portion 22 and between the flat contact portions 315, 415. In addition, the legs 72 are respectively extending downward from two sides of the plate body 71 and extending out of the bottom of the base portion 21. The legs 72 are in contact with the contacts 81 of the circuit board 8. Moreover, the legs 72 may be extending backward from the two sides of the plate body 71 toward the rear of the base portion 21, and the legs 72 are in contact with the rear cover plate 5. The crosstalk interference can be reduced by the shielding of the grounding plate 7 when the flat contact portions 315, 415 transmit signals. Furthermore, the structural strength of the tongue portion 22 can be improved by the assembly of the grounding plate 7. Moreover, the legs 72 extending downward from the two sides of the plate body 71 may be provided as through-hole legs, and the legs 72 are exposed from the base portion 21 to be in contact with the circuit board 8. Furthermore, the grounding plate 7 comprises a plurality of hooks 73 protruded from two sides of the tongue portion 22. When an electrical plug connector is mated with the electrical receptacle connector 100, elastic pieces at two sides of an insulated housing of the electrical plug are engaged with the hooks 73, and the elastic pieces would not wear against the tongue portion 22 of the electrical receptacle connector 100. Additionally, the electrical plug connector may further comprise a plurality of protruded abutting portions, and the protruded abutting portions are in contact with the metallic shell 11 of the electrical receptacle connector 100. Hence, the elastic pieces and the protruded abutting portions are provided for conduction and grounding.

Please refer to FIGS. 2 and 4. In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the base portion 21, and the lower conductive sheet is assembled on the lower portion of the base portion 21. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference problem can be improved.

Based on the above, the holes of the rear cover plate allows an observer to see therethrough and to check the soldering condition between the tail portions of the second receptacle terminals and the contacts of the circuit board. Therefore, the soldering procedure can be redone when soldering spots are not applied to the contacts and the tail portions properly, for example, if the tail portions of the second receptacle terminals and the contacts of the circuit board are not firmly in contact with each other, or if the soldering spots between the tail portions of the second receptacle terminals are merged together to cause short circuit.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, comprising a shell body and a receiving cavity formed in the shell body;

an insulated housing received in the receiving cavity, wherein the insulated housing comprises a base portion and a tongue portion extending from one side of the base portion, the tongue portion has a first surface and a second surface, and the first surface is opposite to the second surface;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion;

a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion; and a rear cover plate extending from the rear of the metallic shell to cover the rear of the base portion, wherein the rear cover plate comprises a baffle plate and a hole on the surface of the baffle plate, the hole is for exposing the tail portions of the second receptacle terminals.

2. The electrical receptacle connector according to claim 1, wherein the insulated housing further comprises a rear side plate extending from the rear of the base portion to cover the tail portions of the second receptacle terminals, wherein the rear side plate comprises a through groove, the tail portions of the second receptacle terminals and the hole correspond to the through groove.

3. The electrical receptacle connector according to claim 1, wherein the baffle plate comprises a flat plate and a turning portion extending from one side of the flat plate toward the rear of the shell body, and the hole is formed on the surface of the flat plate.

4. The electrical receptacle connector according to claim 1, wherein several tail portions of the second receptacle terminals are seen through a visible region of the hole.

5. The electrical receptacle connector according to claim 1, wherein the rear cover plate further comprises a plurality of holes on the surface of the baffle plate for exposing the tail portions of the second receptacle terminals.

6. The electrical receptacle connector according to claim 5, wherein each of the tail portions of the second receptacle terminals is seen through a visible region of the corresponding hole.

7. The electrical receptacle connector according to claim 5, wherein a portion of each of the tail portions of the second receptacle terminals and a portion of an adjacent tail portion of the second receptacle terminal are seen through a visible region of the corresponding hole.

8. The electrical receptacle connector according to claim 1, wherein the shell body comprises an inner shell and a case, the inner shell is circularly enclosing the insulated housing, the case is circularly enclosing the inner shell, and the rear cover plate is extending from the rear of the case and covers the rear of the base portion.

9. The electrical receptacle connector according to claim 1, further comprising a circuit board, wherein the circuit board comprises a plurality of contacts, the tail portions of the second receptacle terminals are formed as SMT legs to be in contact with the contacts.

10. The electrical receptacle connector according to claim 1, wherein the tail portions of the first receptacle terminals are aligned by an offset with respect to the tail portions of the second receptacle terminals.

11. The electrical receptacle connector according to claim 1, wherein the first receptacle terminals and the second receptacle terminals have 180 degree symmetrical design with respect to a central point of the receiving cavity as the symmetrical center.

12. The electrical receptacle connector according to claim 1, wherein the position of the flat contact portions of the first receptacle terminals corresponds to the position of the flat contact portions of the second receptacle terminals.

* * * * *